US008052258B2

(12) United States Patent
Seki et al.

(10) Patent No.: US 8,052,258 B2
(45) Date of Patent: Nov. 8, 2011

(54) FLUID CONTAINER, REMANUFACTURING METHOD OF FLUID CONTAINER, AND SEALING METHOD OF FLUID CONTAINER

(75) Inventors: Yuichi Seki, Matsumoto (JP); Masahide Matsuyama, Nagano-ken (JP); Yasuhiro Ogura, Matsumoto (JP); Yasunao Uehara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 894 days.

(21) Appl. No.: 12/058,633

(22) Filed: Mar. 28, 2008

(65) Prior Publication Data

US 2008/0246825 A1 Oct. 9, 2008

(30) Foreign Application Priority Data

Mar. 29, 2007 (JP) ..... 2007-087506

(51) Int. Cl.
*B41J 2/175* (2006.01)

(52) U.S. Cl. ..... 347/86; 156/324.4; 347/85

(58) Field of Classification Search ..... 349/85–87; 347/85–87; 156/324.4; 399/109; 141/329
See application file for complete search history.

(56) References Cited

U.S. PATENT DOCUMENTS

| | | | | |
|---|---|---|---|---|
| 5,329,294 | A | 7/1994 | Ontawar et al. | |
| 6,238,042 | B1 * | 5/2001 | Kobayashi et al. | 347/86 |
| 6,982,475 | B1 * | 1/2006 | MacIntyre | 257/620 |
| 7,658,480 | B2 * | 2/2010 | Uehara et al. | 347/85 |
| 2003/0124283 | A1 * | 7/2003 | Kawamura et al. | 428/35.7 |
| 2006/0094162 | A1 * | 5/2006 | Yabushita et al. | 438/118 |
| 2006/0132555 | A1 * | 6/2006 | Uehara et al. | 347/85 |
| 2007/0172393 | A1 * | 7/2007 | Beer | 422/99 |

FOREIGN PATENT DOCUMENTS

| | | | |
|---|---|---|---|
| EP | 1 270 235 | A1 | 1/2003 |
| EP | 1 661 710 | A2 | 5/2006 |
| JP | 3118353 | U | 1/2006 |
| JP | 3118670 | U | 1/2006 |

* cited by examiner

*Primary Examiner* — Ellen Kim
(74) *Attorney, Agent, or Firm* — Sughrue Mion, PLLC

(57) ABSTRACT

A method for sealing a bore formed in a cover film is disclosed. An ink inlet hole formed in an ink cartridge is covered at a hole covering area of the cover film. The method includes formation of a recess outside the hole covering area by removing a portion of the cover film, mounting a seal film on the cover film in such a manner that the seal film covers the bore, and sealing the bore with the seal film by heating the seal film with the seal film mounted on the cover film and thereby melting a side of the seal film opposed to the cover film.

27 Claims, 6 Drawing Sheets

FLUID CONTAINER, REMANUFACTURING METHOD OF FLUID CONTAINER, AND SEALING METHOD OF FLUID CONTAINER

CROSS-REFERENCE TO RELATED APPLICATION

This application is based upon and claims the benefit of priority from prior Japanese Patent Application No. 2007-087506, filed on Mar. 29, 2007, the entire content of which is incorporated herein by reference.

BACKGROUND

1. Technical Field

The present invention relates to a fluid container containing fluid, a remanufacturing method of a fluid container by refilling a used fluid contained with fluid, and a sealing method of a fluid container.

2. Related Art

As a liquid container, an ink cartridge removably mounted in an inkjet printer (hereinafter, referred to as a printer), which is a type of liquid ejection apparatus, for example, is known. The ink cartridge has a container body with a substantially flat box-like shape. An ink chamber is defined in the container body to receive ink, which is liquid. An ink inlet hole is formed in a lower surface of the container body to allow initial filling of the ink into the ink chamber. An ink supply hole is also provided in the lower surface of the container body to receive an ink supply needle with the ink cartridge secured to the printer. To suppress leakage of the ink from the ink inlet hole and the ink supply hole, a cover film is bonded to the lower surface of the container body in such a manner as to seal the ink inlet hole and the ink supply hole.

After the ink cartridge is mounted in the printer, the printer consumes the ink through printing. This reduces the amount of the ink retained in the ink chamber until the ink cartridge becomes completely empty. The used ink cartridge is replaced by a new ink cartridge. The container body of the used ink cartridge is still usable for multiple cycles after the ink cartridge is removed from the printer. As disclosed in Japanese Registered Utility Model No. 3118670, a used ink cartridge may be remanufactured as a reusable ink cartridge by refilling the container body of the ink cartridge with ink. Such technique addresses to efficient use of resources and preservation of environments.

According to the technique of the above utility model, a bore is formed in the cover film at a position corresponding to the ink inlet hole using a piercing jig, before the used ink cartridge is refilled with ink. Then, a syringe, for example, is inserted into the ink inlet hole through the bore in the cover film to introduce the ink refill into the container body. Another film (a seal film) is then mounted on the cover film to close the bore and heated to be bonded to the cover film having the bore. In this manner, the bore is sealed and the ink is prevented from leaking from the bore.

A typical cover film is a laminated film formed by a thermally meltable bonding layer film and a surface layer film. The melting temperature of the surface layer film is higher than the melting temperature of the bonding layer film and has an enhanced heat resistance compared to the bonding layer film. The bonding layer film is mounted on the container body while held in contact with the container body and heated in this state. This bonds the bonding layer film to the container body. To remanufacture the used ink cartridge, the ink refill is introduced into the container body through the bore formed in the cover film. Afterwards, the seal film is mounted on the cover film. Like the cover film, the seal film is a laminated film formed by a thermally meltable bonding layer film and a surface layer film, which melts at a temperature higher than the melting temperature of the bonding layer film and has higher heat resistance than the bonding layer film. The bonding layer film of the seal film is placed on the surface layer film of the cover film while held in contact with the surface layer film of the cover film. In this state, the seal film is heated.

However, such heating of the seal film melts the bonding layer film of the seal film but does not melt the surface layer film of the cover film, which is maintained in contact with the bonding layer film of the seal film. It is thus likely that the seal film is not firmly bonded to the cover film. If bonding between the cover film and the seal film is insecure, a gap may be formed between the cover film and the seal film. The gap may allow leakage of the ink from the interior of the ink cartridge through the bore of the cover film.

SUMMARY

Accordingly, it is an objective of the present invention to provide a liquid container remanufactured with improved sealing performance by firmly bonding a seal film to a cover film of a used liquid container, a method for providing the remanufactured liquid container, and a method for sealing the liquid container.

In order achieve the foregoing objective and in accordance with a first aspect of the present invention, a method for sealing a bore formed in a cover film is provided. The cover film is welded or bonded to a liquid container in such a manner as to cover a hole formed in the liquid container at a position corresponding to a hole covering area of the cover film. The bore is formed in the hole covering area. The method includes: forming a recess outside the hole covering area by removing a portion of the cover film; mounting a seal film on the cover film in such a manner that the seal film covers the bore; and sealing the bore with the seal film by heating the seal film with the seal film mounted on the cover film, thereby melting a side of the seal film opposed to the cover film.

In accordance with a second aspect of the present invention, a method for remanufacturing a used liquid container is provided. The liquid container has a hole and a cover film welded or bonded to the liquid container in such a manner as to cover the hole. The method includes: forming a bore in a hole covering area of the cover film covering the hole; refilling the liquid container with liquid through the bore of the cover film and the hole of the liquid container; forming a recess outside the hole covering area by removing a portion of the cover film; mounting a seal film on the cover film in such a manner that the seal film covers the bore; and sealing the bore with the seal film by heating the seal film with the seal film mounted on the cover film, thereby melting a side of the seal film opposed to the cover film.

In accordance with a third aspect of the present invention, a liquid container remanufactured by the method according to the above second aspect of the present invention is provided.

In accordance with a fourth aspect of the present invention, an apparatus for sealing a bore formed in a cover film with a seal film is provided. The cover film is welded or bonded to a liquid container in such a manner as to cover a hole formed in the liquid container at a position corresponding to a hole covering area of the cover film. The bore is provided in the hole covering area. The apparatus includes a recess forming device and a heating device. The recess forming device removes a portion of the cover film, thereby forming a recess outside the hole covering area of the cover film that covers the hole. The heating device heats the seal film, which is mounted on the cover film in such a manner as to cover the bore, thereby melting a side of the seal film opposed to the cover film.

In accordance with a fifth aspect of the present invention, a liquid container having a hole is provided. The container includes a cover film and a seal film. The cover film welded or bonded to the liquid container. The cover film has a bore in a hole covering area thereof which covers the hole of the liquid container and a portion without film outside of the hole covering area. The seal film welded or bonded to the liquid container through the portion of the cover film in such a manner as to cover the bore of the cover film and the hole of the liquid container.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF EXEMPLARY EMBODIMENTS

An embodiment of the present invention will now be described with reference to FIGS. 1 to 10. In the following description, the "front-and-rear direction", the "left-and-right" direction, and the "up-and-down" direction are the directions indicated by the corresponding arrows in FIGS. 1 to 4.

Figure 2:
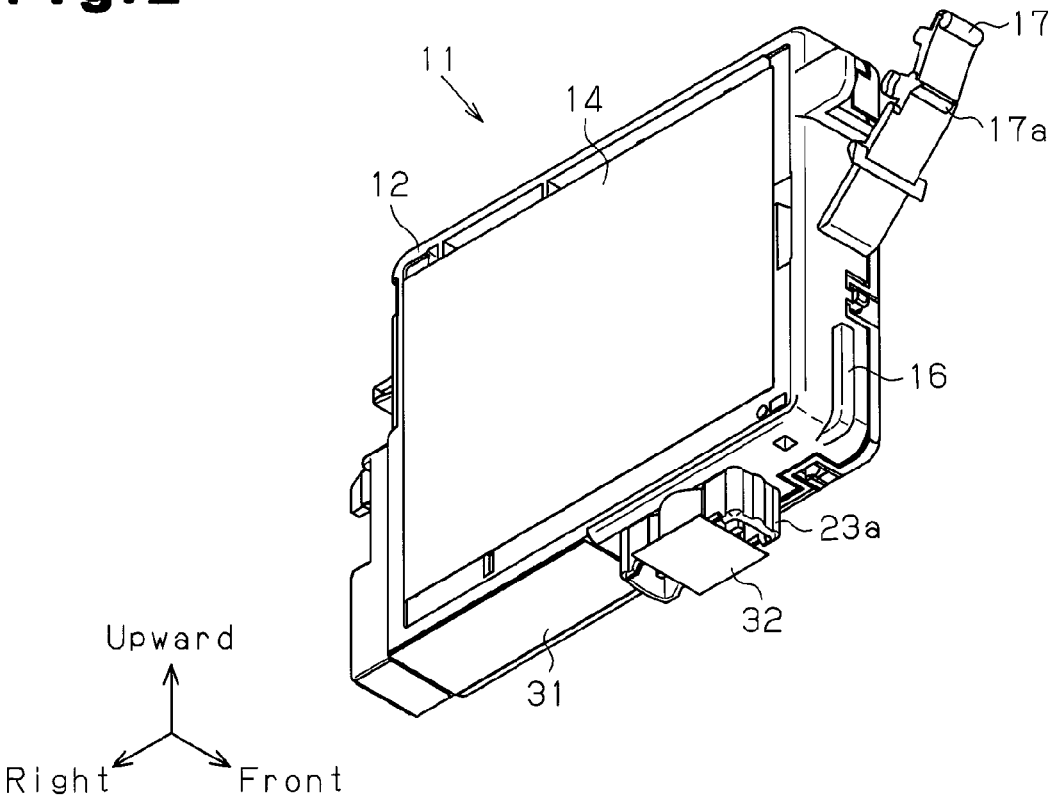
FIG. 2 is a rear perspective view showing the ink cartridge of FIG. 1.
Figure 3:
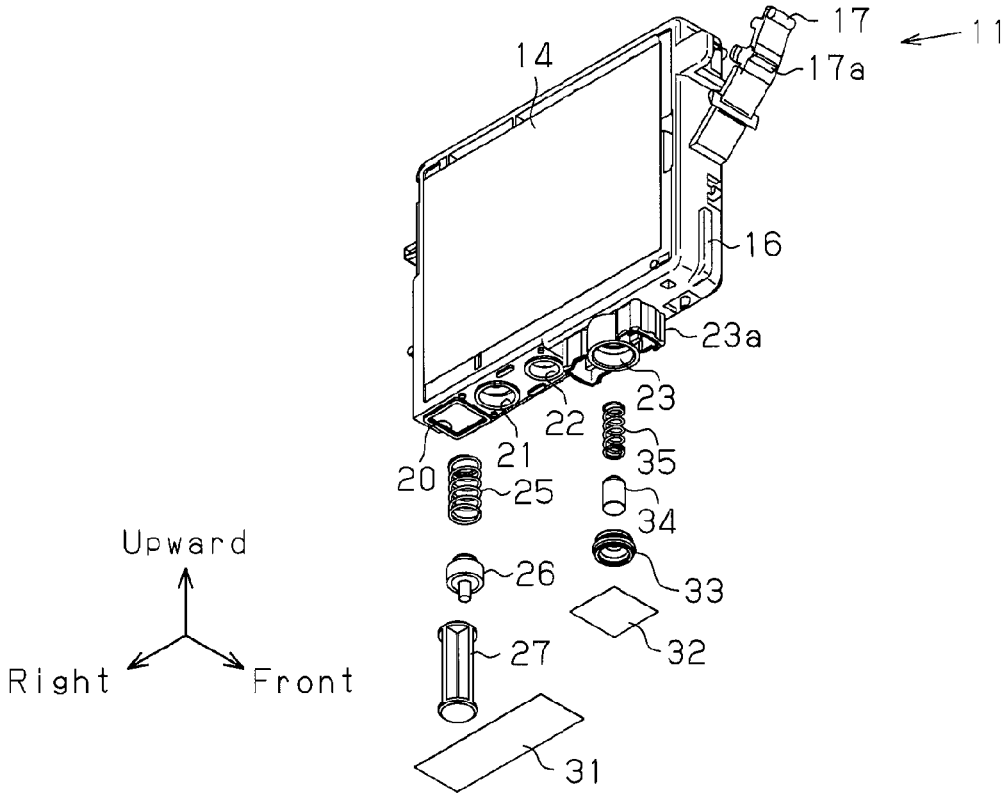
FIG. 3 is a partially exploded front perspective view showing the ink cartridge of FIG. 1.
Figure 4:
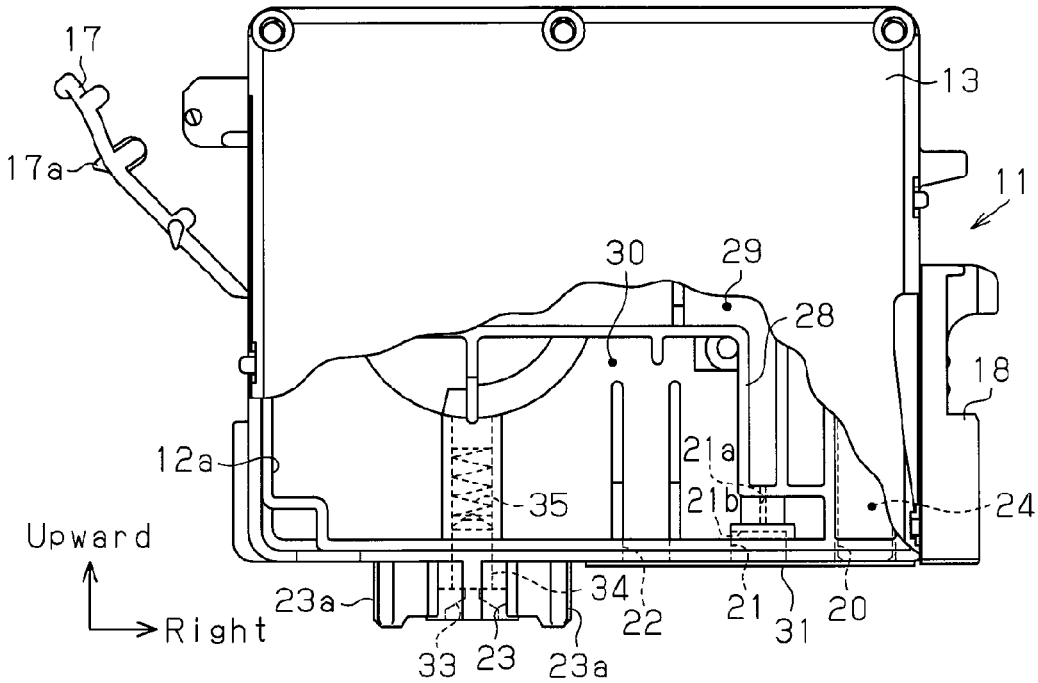
FIG. 4 is a front view, with a part cut away, showing the ink cartridge of FIG. 1.

As shown in FIGS. 1 to 4, an ink cartridge 11, or a fluid container of the illustrated embodiment, includes a container body 12, which is shaped substantially like a flat rectangular box and formed of synthetic resin, which is, for example, polypropylene (PP). With reference to FIG. 4, an opening 12*a* is formed in a front surface of the container body 12. A film member (not shown), which is formed of thermally adhesive material, is welded to the container body 12 to substantially cover the entire opening 12*a*. A lid body 13 is detachably attached to the container body 12 from outside the film member (the side corresponding to the front surface) in such a manner that the opening 12*a* is shielded. A film member 14, which is formed of thermally adhesive material, is bonded to a rear surface of the container body 12 to substantially cover the entire rear surface. An elongated ID label 15, which represents the color of the ink, or the fluid, contained in the ink cartridge 11, is welded to an upper surface of the container body 12.

As shown in FIGS. 2 to 4, a guide projection 16 extending in the up-and-down direction projects from a lower portion of a left surface of the container body 12. If the ink cartridge 11 is mounted in a cartridge holder (not shown) of an inkjet printer (hereinafter, referred to as a printer), which is a type of fluid ejection apparatus, the guide projection 16 is received in a guide recess (not shown) formed in the cartridge holder. This guides the ink cartridge 11 when the ink cartridge 11 is mounted in the cartridge holder.

With reference to FIGS. 1 to 4, an elastically deformable engagement lever 17, which projects diagonally to the upper left, is arranged at a position above the guide projection 16 on the left surface of the container body 12. An engagement piece 17*a*, which extends horizontally (in the front-and-rear direction), projects substantially from the longitudinal center of the engagement lever 17 on a surface of the engagement lever 17. Thus, when the ink cartridge 11 is mounted in the cartridge holder of the printer, the engagement lever 17 elastically deforms and the engagement piece 17*a* becomes engaged with a portion of the cartridge holder. This positions the ink cartridge 11 with respect to the cartridge holder. The ink cartridge 11 is thus secured to the cartridge holder in the positioned state.

Figure 1:
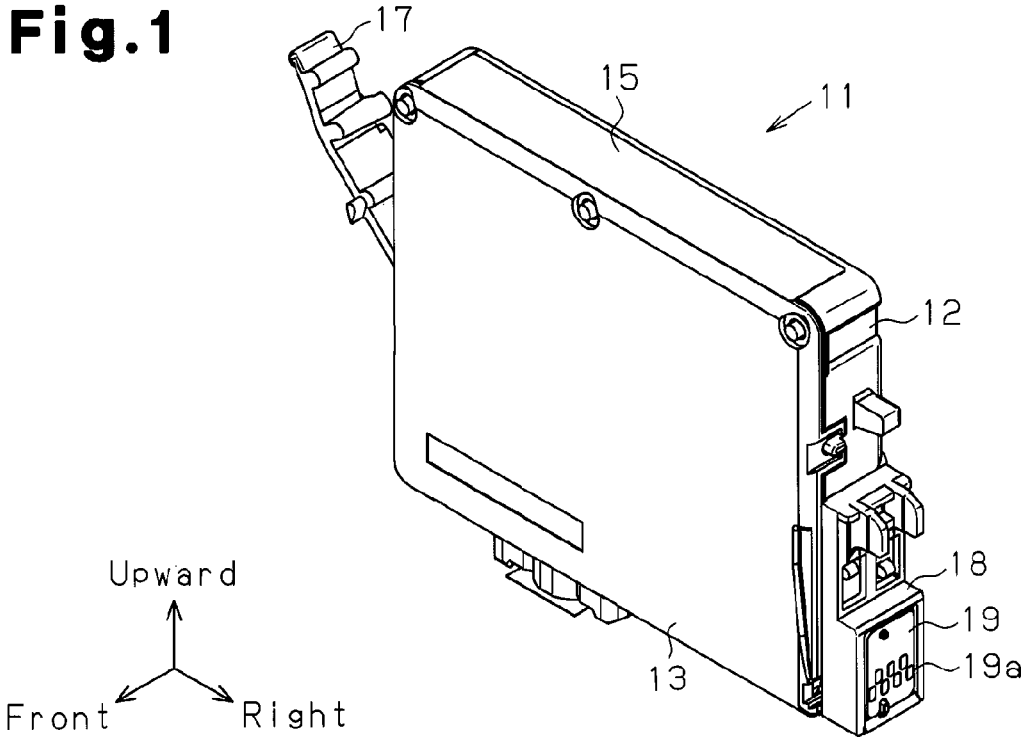
FIG. 1 is a front perspective view showing an ink cartridge according to an embodiment of the present invention.

As shown in FIG. 1, a substrate unit 18 is secured to a lower portion of a right surface of the container body 12. A circuit substrate 19 on which a semiconductor memory device is mounted is arranged on a surface of the substrate unit 18. The semiconductor memory device of the circuit substrate 19 stores various information regarding the ink cartridge 11 (for example, information regarding ink colors and ink containing amounts). Terminals 19*a* are provided on the surface of the circuit substrate 19. When the ink cartridge 11 is mounted in the cartridge holder of the printer, the terminals 19*a* contact connection terminals formed in the cartridge holder. This transfers various information between the circuit substrate 19 and a control device (not shown) of the printer.

As illustrated in FIGS. 3 and 4, a rectangular opening 20, a first ink inlet hole 21 having a circular shape, a second ink inlet hole 22 having a circular shape, and an ink supply port 23 having a circular shape are formed in a lower surface (a hole forming surface S) of the container body 12 and arranged in this order from the right end to the left end of the lower surface. The ink supply port 23 has a pair of guide walls 23*a* each having a substantial U shape, which are provided at the right end and the left end of the ink supply port 23. The interior of the opening 20 defines an atmospheric air communication chamber 24, which configures a portion of an atmospheric air communication passage. The atmospheric air communication chamber 24 communicates with the exterior of the container body 12, or the atmospheric air, through a non-illustrated atmospheric air exposure port. The atmospheric air communication chamber 24 accommodates a coil spring 25, a valve body 26, and a valve support member 27 in this order from inward to outward.

A rib 28 defines an upper ink chamber 29 and a lower ink chamber 30 in the container body 12. The first ink inlet hole 21 communicates with the upper ink chamber 29 and the lower ink chamber 30 through a narrow passage 21*a* and a narrow ink inlet port 21*b*, which are formed in the container body 12. The second ink inlet hole 22 communicates directly with the lower ink chamber 30. In initial filling of the ink chambers 29, 30, ink is introduced through the ink inlet holes 21, 22. After such initial filling, the first and second ink inlet holes 21, 22 are sealed by a cover film 31 along with the opening 20 as illustrated in FIGS. 2 to 4.

The cover film 31 has a two-layer structure formed by a bonding layer film 31*a* and a surface layer film 31*b*. As illustrated in FIGS. 5C to 9B, the bonding layer film 31*a* is welded to a lower surface of the container body 12. In this state, the surface layer film 31*b* is arranged on the bonding layer film 31*a* in such a manner that the surface layer film 31*b* is exposed to the exterior. As the bonding layer film 31*a*, a polyolefin (PO) based film or an ester based film, which melts at a predetermined temperature and has improved welding performance may be employed. The surface layer film 31*b* is constituted by a polyethylene terephthalate (PET) based film or a nylon (NY) based film, which do not melt at the melting temperature of the bonding layer film 31*a* and has higher heat resistance than the bonding layer film 31*a*.

When the ink cartridge 11 is secured to the cartridge holder of the printer, an ink supply needle (not shown) provided in the cartridge holder is inserted into the ink supply port 23. With reference to FIGS. 2 and 3, the ink supply port 23 is sealed by a cover film 32 before the ink cartridge 11 is mounted in the cartridge holder. Like the cover film 31, the cover film 32 has a two-layer structure formed by a bonding layer film and a surface layer film. The cover film 32 may be either removed from the ink cartridge 11 before mounting of the ink cartridge 11 in the cartridge holder or penetrated by the ink supply needle of the cartridge holder when the ink cartridge 11 is secured to the cartridge holder.

As illustrated in FIGS. 3 and 4, the interior of the ink supply port 23 accommodates an annular seal member 33 formed of elastomer or the like, a supply valve 34, and a coil spring 35. The seal member 33 allows penetration of the ink supply needle of the cartridge holder into the ink supply port 23. The supply valve 34 is brought into contact with the seal member 33. The coil spring 35 urges the supply valve 34 toward the seal member 33. Specifically, the supply valve 34 is urged by the coil spring 35 to be pressed against the seal member 33, thus closing the ink supply port 23. This constantly prevents the ink from flowing from the interior of the container body 12 to the exterior through the ink supply port 23. Contrastingly, when the ink supply needle of the cartridge holder is inserted into the ink supply port 23, the ink supply needle presses the supply valve 34 inwardly in the ink supply port 23 against the urging force of the coil spring 35. The supply valve 34 is thus separated from the seal member 33. This opens the ink supply port 23, allowing the ink to flow from the interior of the container body 12 to the exterior through the ink supply port 23.

After the ink cartridge 11 is mounted in the cartridge holder of the printer, the printer consumes the ink until the ink is used up. At this stage, the used ink cartridge 11 is removed from the cartridge holder and replaced by a new ink cartridge 11. The used ink cartridge 11 is then refilled with ink and remanufactured as a reusable ink cartridge without being discarded. This contributes to efficient use of resources and preservation of environments.

A method for remanufacturing the used ink cartridge 11 will hereafter be explained with reference to FIGS. 5A to 10A.

Figure 5A:
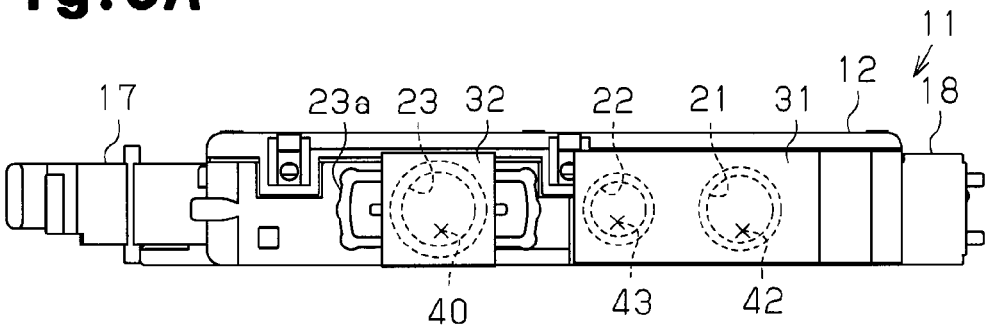
FIG. 5A is a bottom view showing a new ink cartridge.
Figure 5B:
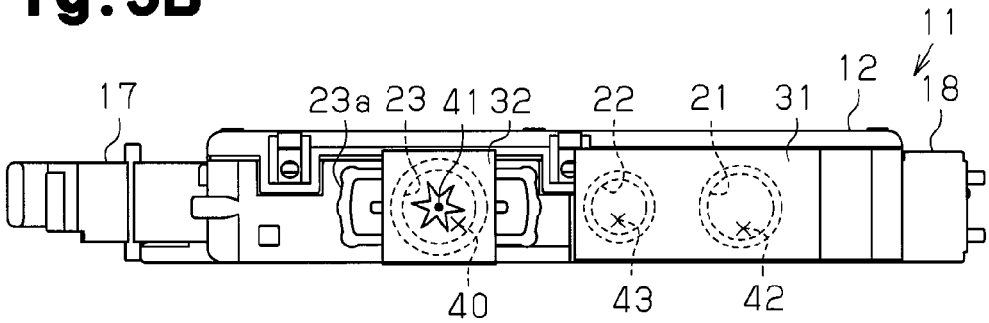
FIG. 5B is a bottom view showing a used ink cartridge.

With reference to FIG. 5A, in a new ink cartridge 11 before it is mounted in the cartridge holder of the printer, the cover films 31, 32 are welded to the lower surface of the container body 12. When removed from the cartridge holder, with reference to FIG. 5B, a used ink cartridge 11 has a bore 41 at the center of a hole covering area 40 of the cover film 32 covering the ink supply port 23. The bore 41 is formed through penetration of the cover film 32 by the ink supply needle of the printer. However, there are no bores formed in hole covering areas 42, 43 of the cover film 31 covering the ink inlet holes 21, 22. In other words, the used ink cartridge 11 is recovered in the state illustrated in FIG. 5B.

Figure 5C:
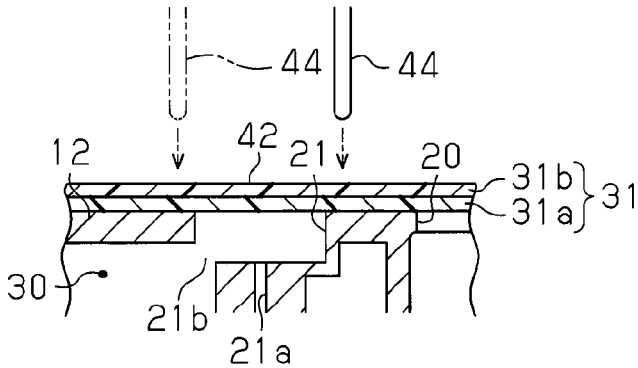
FIG. 5C is a diagram illustrating a state of the ink cartridge immediately before grooves are formed.
Figure 6:
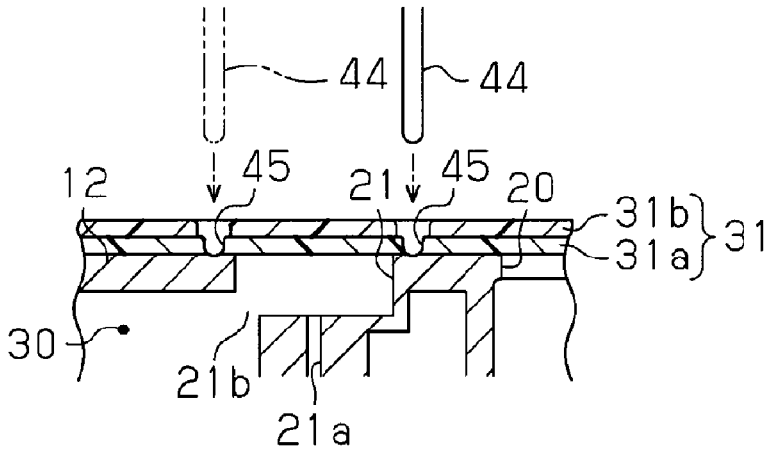
FIG. 6 is a diagram illustrating a step of forming grooves.

To remanufacture the used ink cartridge 11 as a recovered ink cartridge, the ink cartridge 11 is arranged in a reversed posture with the lower surface of the container body 12 facing upward, as illustrated in FIG. 5C. FIG. 5C is a cut-away view showing the portion of the container body 12 in which the first ink inlet hole 21 is formed. A laser beam irradiation nozzle 44 as a recess forming device is deployed at a position above the container body 12 held in the reversed posture. Specifically, as illustrated in FIG. 5C, the laser beam irradiation nozzle 44 is arranged in such a manner as to irradiate a laser beam onto a portion of an outer side of the hole covering area 42 of the cover film 31, which is welded to the lower surface of the container body 12.

Subsequently, in the state of FIG. 5C, the laser beam irradiation nozzle 44 irradiates a laser beam onto the portion of the outer side of the hole covering area 42 of the cover film 31. Then, with reference to FIG. 6, a groove 45, which is a recess, is formed in the outer side of the hole covering area 42 of the cover film 31. As represented by the solid lines and the double-dotted chain lines in FIGS. 5C and 6, the laser beam irradiation nozzle 44 irradiates the laser beam while revolving along the circumference of the hole covering area 42 of the cover film 31. This provides the single annular groove 45 in the outer side of the hole covering area 42 of the cover film 31, with reference to FIG. 10A.

As a result, the annular portion of the surface layer film 31*b* extending along the groove 45 is removed. Further, the annular portion of the bonding layer film 31*a*, which is located below the surface layer film 31*b*, extending along the groove 45 is also removed. This exposes the portion of the bonding layer film 31*a* that has been covered from above by the surface layer film 31*b* (the portion forming the inner wall surface of the groove 45) and the lower surface of the container body 12 (the portion forming the bottom of the groove 45) to the exterior.

Figure 7:
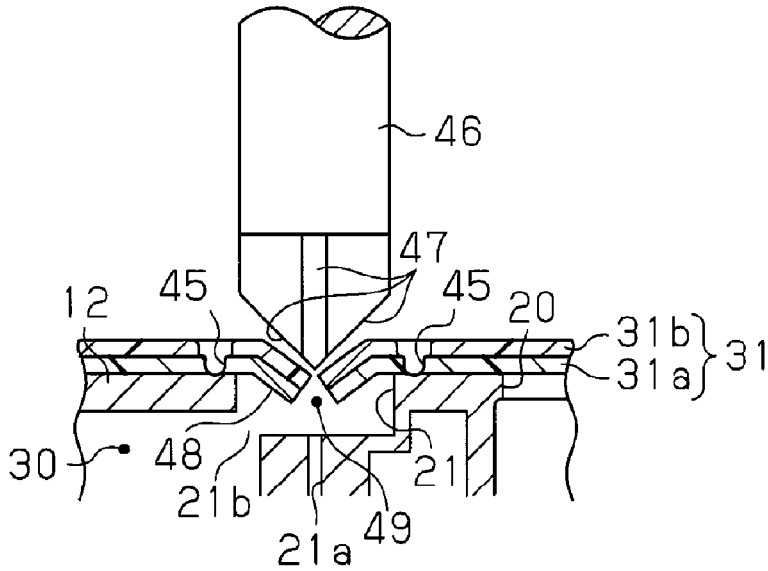
FIG. 7 is a diagram illustrating a piercing step.

Next, to form an ink refill bore in the hole covering area 42 of the cover film 31 corresponding to the first ink inlet hole 21, a piercing blade body 46 is arranged to be opposed to the hole covering area 42 corresponding to the first ink inlet hole 21 in the up-and-down direction. As shown in FIG. 7, four blade portions 47 are formed in a distal portion of the piercing blade body 46. The blade portions 47 extend radially from the axis of the piercing blade body 46, as viewed in the axial direction of the blade body 46 from the distal portion of the blade body 46. The four blade portions 47 are provided at equal angular intervals (in the illustrated embodiment, 90 degrees). The piercing blade body 46 is then moved from this position toward the lower surface of the container body 12, as illustrated in FIG. 7. This causes the blade portions 47 to penetrate the hole covering area 42 of the cover film 31 corresponding to the first ink inlet hole 21.

In this manner, the blade portions 47 of the piercing blade body 46 form a cross-shaped cut extending radially from a point coinciding with the center of the first ink inlet hole 21 in the hole covering area 42 of the cover film 31. The cut provides four cut pieces 48, which hang down in the first ink inlet hole 21 separately from one another in radial directions. As a result, a bore 49, through which ink refill is introduced, is formed in the hole covering area 42 of the cover film 31 corresponding to the first ink inlet hole 21. In other words, at this stage, the hole covering area 42 of the cover film 31 has the bore 49.

Subsequently, a groove 45 is formed around the circumference of the hole covering area 43 of the cover film 31 corresponding to the second ink inlet hole 22. Then, using the blade portions 47 of the piercing blade body 46, the bore 49 is formed in the hole covering area 43. Although the step of forming the groove 45 through irradiation of a laser beam may be performed either before or after the step of forming the bore 49 using the piercing blade body 46, it is preferable that the step of forming the groove 45 be carried out before the step of forming the bore 49. In this manner, smoke produced by the cover film 31 molten through the laser irradiation is prevented from entering the interior of the ink cartridge 11.

Alternatively, in the step of forming the bore 49 in the cover film 31, the laser beam irradiation nozzle 44, with which the groove 45 is formed, may be used to form the bore 49 by irradiating the laser beam from the laser beam irradiation nozzle 44. In this case, the piercing blade body 46 becomes unnecessary in the step of forming the bore 49. Further, since the laser beam irradiation nozzle 44 is used commonly for the steps of forming the groove 45 and the bore 49, the cost for facilities is reduced, and generation of swarf is reliably suppressed.

Figure 8:
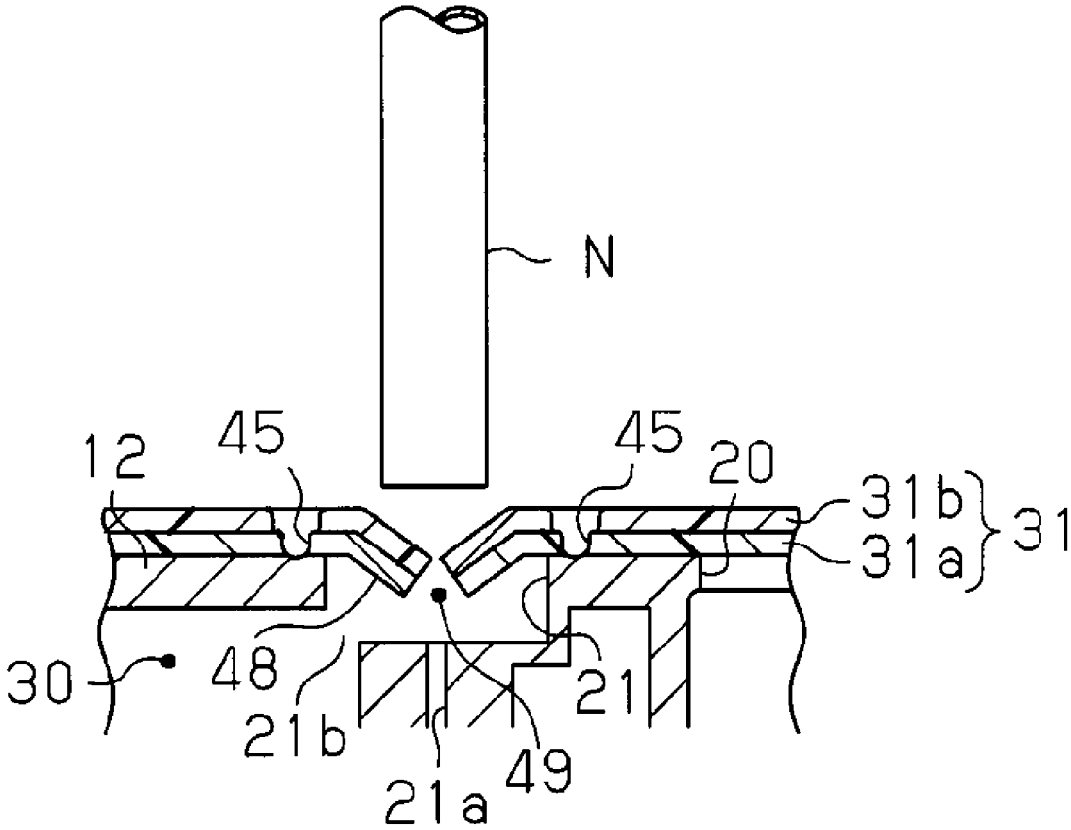
FIG. 8 is a cross-sectional view showing a portion of the ink cartridge when ink is introduced into the ink cartridge through a bore.

Next, with reference to FIG. 8, the ink introduction nozzles N are inserted into the ink inlet holes 21, 22 through the corresponding bores 49. Ink refill is thus introduced into the ink chambers 29, 30, with which the ink inlet holes 21, 22 communicate. After such introduction of the ink refill, the bores 49, which have been provided for ink refilling, and the bore 41 of the cover film 32 formed by the ink supply needle are sealed by a laminated film 50 serving as a seal film. In this manner, a reusable ink cartridge 11 is provided.

Figure 9A:
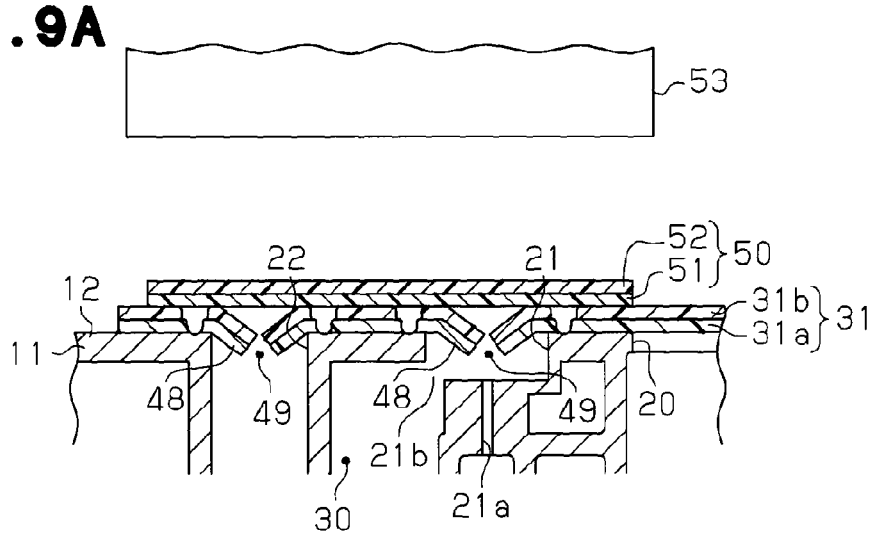
FIG. 9A is a cross-sectional view showing a portion of the container body in which a first ink inlet hole and a second ink inlet hole are formed before a sealing step.
Figure 9B:
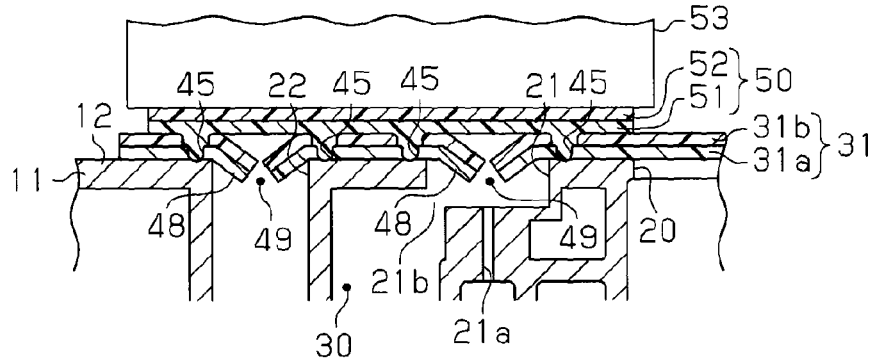
FIG. 9B is a cross-sectional view showing the portion of the container body in which the first ink inlet hole and the second ink inlet hole are formed after the sealing step.

A method for sealing the bores 49 of the cover film 31 and the bore 41 of the cover film 32 using the laminated film 50 will hereafter be explained with reference to FIGS. 9A and 9B. FIGS. 9A and 9B are cross-sectional views showing the portions of the container body 12 in which the first ink inlet hole 21 and the second ink inlet hole 22 are formed.

With reference to FIG. 9A, to seal the bores 49 of the cover film 31, the laminated film 50 is mounted on the cover film 31. The laminated film 50 has a two-layer structure formed by a first film 51 and a second film 52. The first film 51 melts when heated to a predetermined temperature. The second film 52 does not melt at the melting temperature of the first film 51 and has higher heat resistance than the first film 51. In other words, in the laminated film 50, the first film 51 forms an outermost layer on one side with respect to the lamination directions of the films 51, 52, and the second film 52 forms an outermost layer on the other side.

With the first film 51 held in contact with the surface layer film 31*b* of the cover film 31, the laminated film 50 is mounted on the container body 12 in such a manner as to close the bores 49 corresponding to the ink inlet holes 21, 22. Specifically, since the first film 51 is heated and welded to the cover film 31, the first film 51 is held in contact with the cover film 31 opposed to the container body 12. By arranging the second film 52 on the outer side, the second film 52 with enhanced heat resistance is allowed to maintain its sealing performance.

As the first film 51, a polyolefin (PO) based film, an ester based film, or an easy-peel-open (EPO) film may be employed. These films melt at a predetermined temperature and exhibit enhanced welding performance. If the EPO film is used, welding performance of the EPO film allows the laminated film 50 to be welded to the cover film 31 and then, when necessary, the laminated film 50 may be easily peeled off from the cover film 31 to re-expose the bores 49.

The second film 52 is formed by a film that does not melt at the melting temperatures of the films such as the above-listed polyolefin (PO) based film and has higher heat resistance than the PO based film. The film includes a polyethylene terephthalate (PET) based film and a nylon (NY) based film. The thickness of the first film 51, which is laminated with the second film 52, is set to 20 to 60 μm. For example, in the present embodiment, the thickness of the first film 51 is 25 μm. The thickness of the first film 51 is set to 20 μm or greater so that formation of a gap between the second film 52 and the first film 51 is prevented even if the welded surface of the second film 52 with respect to the first film 51 is uneven. The thickness of the first film 51 is set to 60 μm or less so that increase of the cost and decrease of heat conduction of the first film 51 in heating, which are brought about by an excessive thickness of the first film 51, are prevented.

After the laminated film 50 is mounted on the cover film 31, a heater 53 serving as a heating device is lowered toward the laminated film 50 from above the laminated film 50 as illustrated in FIG. 9A. The heater 53 is heated to a predetermined temperature at which the first film 51 of the laminated film 50 melts and the second film 52 does not melt. The heater 53 is shaped as a block body having a flat pressing surface capable of contacting the surface of the laminated film 50 (the surface of the second film 52) in a surface contact manner.

Thus, with reference to FIG. 9B, if the heater 53 heats the laminated film 50 while being held in a surface contact state with the surface of the laminated film 50, not only the annular areas along the circumferences of the bores 49 of the cover film 31 but also the covered areas of the bores 49, which are the interiors of the corresponding annular areas, are also heated. This reliably melts and welds the annular areas along the circumferences of the bores 49 and the covered areas of the bores 49. As a result, change of strength of the laminated film 50, particularly the first film 51, caused by heating becomes uniform as a whole. This suppresses variation of the strength among portions of the laminated film 50.

As the first film 51 melts through heating by the heater 53, molten film material from the first film 51 flows into the grooves 45 formed around the hole covering areas 42, 43 of the cover film 31. The film material then cools down and solidifies in the grooves 45. The laminated film 50 thus exerts an anchor effect and is firmly bonded to the cover film 31.

The molten film material in the grooves 45 then contacts portions of the bonding layer film 31*a* that are exposed through the grooves 45. The molten film material further proceeds to the bottoms of the grooves 45 and contact the lower surface of the container body 12.

The bonding layer film 31*a* of the cover film 31 is formed by a polyolefin (PO) based film or an ester based film, which melt at the melting temperature of the first film 51. The lower surface of the container body 12 is formed of synthetic resin such as polypropylene (PP), which melts at the melting temperature of the first film 51. Thus, as the first film 51 of the laminated film 50 melts through heating by the heater 53, the portions of the bonding layer film 31*a* exposed through the grooves 45 and the lower surface of the container body 12 melt and are thus fused with the molten first film 51.

This firmly welds the laminated film 50 to the cover film 31 and the container body 12, thus reliably sealing the bores 49 extending through the cover film 31. Afterwards, the heater 53 is raised from the contact position illustrated in FIG. 9B to the standby position illustrated in FIG. 9A.

After the bores 49 of the cover film 31 are sealed by the laminated film 50 as has been described, a groove similar to the above-described grooves is formed around the hole covering area of the cover film 32 corresponding to the ink supply port 23 through irradiation of a laser beam. Then, a laminated film serving as a seal film is welded to the cover film 32 to seal the bore 41 of the cover film 32. By completing the sealing step as has been described, a remanufactured ink cartridge 11 having effective sealing performance is obtained.

The illustrated embodiment has the following advantages.

(1) The laminated film 50 is heated in a state mounted on the cover films 31, 32. This melts the film material forming the first film 51 of the laminated film 50, which is held in contact with the cover films 31, 32. The molten film material enters the grooves 45 provided around the hole covering areas 42, 43, 40. The molten film material then cools down and solidifies in the grooves 45, thus exerting an anchor effect. This firmly bonds the laminated film 50 with the cover films 31, 32, allowing the laminated film 50 to reliably seal the bores 49, 41 of the cover films 31, 32. The ink is thus reliably prevented from leaking from inside the container body 12 to the exterior through the bores 49, 41 of the cover films 31, 32.

(2) The thermally molten film material from the first film 51 in the grooves 45 is welded to the portions of the bonding layer films 31*a* and the portion of the container body 12 that are exposed through the grooves 45. The second film 52, or the surface layer of the laminated film 50, has higher heat resistance than the first film 51. As a result, the remanufactured ink cartridge 11 has enhanced sealing performance.

(3) The laminated film 50 is heated while seated on the cover films 31, 32. This melts and welds the first film 51 of the laminated film 50 and the bonding layer film 31*a* of the cover film 31, 32 together, as well as the first film 51 and the lower surface of the container body 12, in the grooves 45. This further firmly bonds the cover films 31, 32 of the laminated film 50 and the container body 12 of the ink cartridge 11 with the container body 12.

(4) After the laminated film 50 is welded to the cover films 31, 32, single annular seal portions are formed around the bores 49 of the cover films 31, 32 and along the corresponding grooves 45. In other words, the film material of the first film 51 that has entered the grooves 45 through heating of the laminated film 50 cools down and solidifies to function as seal portions around the bores 49 of the cover films 31, 32. The seal portions effectively prevent the ink from leaking through the bores 49 of the cover films 31, 32.

(5) The grooves 45 are formed in the cover films 31, 32 through laser irradiation. This suppresses generation of swarf from the cover films 31, 32 and rapidly provides the grooves 45.

(6) After the ink refill is introduced through the bores 49 of the cover film 31, the laminated film 50 is firmly bonded to the cover film 31 to seal the bores 49. In this manner, the ink cartridge 11 is remanufactured with improved sealing performance.

(7) Since the remanufactured ink cartridge 11 has the improved sealing performance, leakage of the ink is reliably suppressed.

(8) The cross-shaped cuts provided by the piercing blade body 46 in the cover film 31 each form the cut pieces 48 forming the corresponding bore 49 of the cover film 31 by hanging down in the associated ink inlet hole 21, 22. This suppresses fragmentation of the cover film 31, thus preventing the ink refill introduced through the bores 49 from being mixed with film fragments. The passages (for example, the narrow passage 21*a* and the narrow ink inlet port 21*b*) in the remanufactured ink cartridge 11 are thus prevented from clogging. As a result, the ink cartridge 11 is remanufactured in an optimal state.

The above illustrated embodiment may be modified as follows.

Figures 10A, 10B, 10C, 10D:
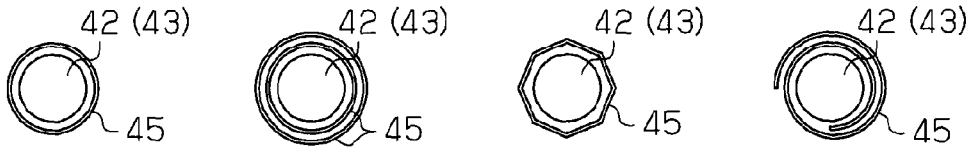
FIG. 10A is a plan view showing a groove according to the embodiment of FIGS. 1 to 9B.
FIG. 10B is a plan view showing a recess according to a modification.
FIG. 10C is a plan view showing a recess according to another modification.
FIG. 10D is a plan view showing a recess according to another modification.

As illustrated in FIG. 10B, the groove 45 formed around the hole covering area 42 (43) of the cover film 31 (32) may be shaped in a double annular manner. That is, as long as the groove 45 has at least a single annular portion, the groove 45 may be formed in, for example, a triple annular shape.

With reference to FIG. 10C, the groove 45 formed around the hole covering area 42 (43) of the cover film 31 (32) may be formed in, for example, an octagonal shape, instead of an annular shape.

As illustrated in FIG. 10D, the shape of the groove 45 formed around the hole covering area 42 (43) of the cover film 31 (32) is not restricted to an annular shape, but may be, for example, a spiral shape.

The groove 45 around the hole covering area 42 does not necessarily have to be formed by the single laser beam irradiation nozzle 44, which revolves around the hole covering area 42. Specifically, a plurality of laser beam irradiation nozzles 44 may revolve around the hole covering area 42 along concentric circular paths, thus providing a groove shaped as a single circle or multiple circles.

Instead of using irradiation of a laser beam, each groove 45 may be formed using a blade body such as a punch or a cutter knife, which forms a cut in the cover film 31 (32) along an annular or spiral path.

Each groove 45 does not necessarily have to reach the lower surface of the container body 12 of the ink cartridge 11. The groove 45 may be formed in such a manner that only the bonding layer film 31*a* of the cover film 31 (32) is exposed.

The depth of each groove 45 may be set in such a manner that, after the molten film material of the first film 51 solidifies in the groove 45, the film material exerts the anchor effect with respect to the surface layer film 31*b* of the cover film 31 (32) solely.

Instead of each annular groove 45, a plurality of recesses arranged at separate positions may be provided outside the hole covering area 42 (43) of the cover film 31 (32). The recesses receive the molten film material from the first film 51 and the molten film material exerts the anchor effect in this state. As a result, the bonding strength of the laminated film 50 with respect to the cover films 31, 32 is enhanced.

As long as the lower surface of the container body 12 of the ink cartridge 11, to which the cover films 31, 32 are welded, is formed of a material (which is, for example, synthetic resin such as polypropylene) that melts at the melting temperature of the first film 51, the portions of the container body 12 other than the lower surface may be formed of a highly heat resistant synthetic resin or metal that does not melt at the melting temperature of the first film 51.

As long as the thickness of the first film 51 of the laminated film 50 falls in the range of 20 to 60 μm, such thickness may be a value other than 25 μm.

As long as the first film 51 of the laminated film 50 melts when heated by the heater 53, the first film 51 may be, for example, a urethane based film.

The laminated film 50 may be formed by three or more layers. That is, the laminated film 50 may have an additional film (additional films) sandwiched between the first film 51 and the second film 52. In other words, as long as the outermost layer of the laminated film 50 contacting the cover film 31 is the first film 51 and the opposing outermost film is the second film 52, the laminated film 50 may be configured in any suitable manner.

In the illustrated embodiment, the liquid container is embodied by the ink cartridge. However, the liquid container may be a liquid container that contains liquid (including a liquefied body formed by dispersing or mixing functional material particles in liquid or a flowable body such as gel) other than ink. The "liquid" herein includes, for example, not only inorganic solvents, organic solvents, solutions, liquefied resins, and liquefied metals (molten metals), but also liquefied bodies, flowable bodies, and powder particulates.

What is claimed is:

1. A method for sealing a bore formed in a cover film, the cover film being welded or bonded to a liquid container in such a manner as to cover a hole formed in the liquid container at a position corresponding to a hole covering area of the cover film, the bore being formed in the hole covering area, the method comprising:

forming a recess outside the hole covering area by removing a portion of the cover film;

mounting a seal film on the cover film in such a manner that the seal film covers the bore; and sealing the bore with the seal film by heating the seal film with the seal film mounted on the cover film, thereby melting a side of the seal film opposed to the cover film.

2. The method according to claim 1, wherein the seal film is a laminated film formed by laminating a plurality of films including a first film and a second film, the first film being meltable at a predetermined heating temperature, the second film being non-meltable at the heating temperature and having a higher heat resistance than the first film, the first film being one of two outermost layers of the laminated film, the second film being the other of the outermost layers, wherein the seal film is mounted on the cover film in such a manner that the first film is opposed to the cover film, and wherein the seal film is heated from the side corresponding to the second film so that the first film becomes molten and welded to the liquid container through the recess of the cover film.

3. The method according to claim 2, wherein the liquid container has a hole forming surface in which the hole is formed, the cover film being a laminated film formed by laminating a plurality of films including a bonding layer film and a surface layer film, the bonding layer film being meltable at the heating temperature and welded to the hole forming surface, the surface layer film being non-meltable at the heating temperature and having a higher heat resistance than the bonding layer film, and wherein the recess is formed by removing the surface layer film in such a manner as to expose the bonding layer film.

4. The method according to claim 1, wherein the liquid container has a hole forming surface in which the hole is formed, at least the hole forming surface of the liquid container being formed of a thermally meltable material, wherein the recess is formed in such a manner as to expose the hole forming surface, and wherein the seal film is heat-welded to the hole forming surface of the liquid container through the recess.

5. The method according to claim 1, wherein the recess is an at least single annular or spiral groove formed in such a manner as to encompass the hole covering area of the cover film.

6. The method according to claim 1, wherein the recess is formed through irradiation of a laser beam.

7. A method for remanufacturing a used liquid container, the liquid container having a hole and a cover film welded or bonded to the liquid container in such a manner as to cover the hole, the method comprising:

forming a bore in a hole covering area of the cover film covering the hole;

refilling the liquid container with liquid through the bore of the cover film and the hole of the liquid container;

forming a recess outside the hole covering area by removing a portion of the cover film;

mounting a seal film on the cover film in such a manner that the seal film covers the bore; and sealing the bore with the seal film by heating the seal film with the seal film mounted on the cover film, thereby melting a side of the seal film opposed to the cover film.

8. The method according to claim 7, wherein the seal film is a laminated film formed by laminating a plurality of films including a first film and a second film, the first film being meltable at a predetermined heating temperature, the second film being non-meltable at the heating temperature and having a higher heat resistance than the first film, the first film being one of two outermost layers of the laminated film, the second film being the other of the outermost layers, wherein the seal film is mounted on the cover film in such a manner that the first film is opposed to the cover film, and wherein the seal film is heated from the side corresponding to the second film so that the first film becomes molten and welded to the liquid container through the recess of the cover film.

9. The method according to claim 8, wherein the liquid container has a hole forming surface in which the hole is formed, the cover film being a laminated film formed by laminating a plurality of films including a bonding layer film and a surface layer film, the bonding layer film being meltable at the heating temperature and welded to the hole forming surface, the surface layer film being non-meltable at the heating temperature and having a higher heat resistance than the bonding layer film, and wherein the recess is formed by removing the surface layer film in such a manner as to expose the bonding layer film.

10. The method according to claim 7, wherein the liquid container has a hole forming surface in which the hole is formed, at least the hole forming surface of the liquid container being formed of a thermally meltable material, wherein the recess is formed in such a manner as to expose the hole forming surface, and wherein the seal film is heat-welded to the hole forming surface of the liquid container through the recess.

11. The method according to claim 7, wherein the recess is an at least single annular or spiral groove formed in such a manner as to encompass the hole covering area of the cover film.

12. The method according to claim 7, wherein the recess is formed through irradiation of a laser beam.

13. The method according to claim 7, wherein the bore is formed through irradiation of a laser beam.

14. A liquid container remanufactured by the method according to claim 7.

15. An apparatus for sealing a bore formed in a cover film with a seal film, the cover film being welded or bonded to a liquid container in such a manner as to cover a hole formed in the liquid container at a position corresponding to a hole covering area of the cover film, the bore being provided in the hole covering area, the apparatus comprising:

a recess forming device that removes a portion of the cover film, thereby forming a recess outside the hole covering area of the cover film that covers the hole; and a heating device that heats the seal film, which is mounted on the cover film in such a manner as to cover the bore, thereby melting a side of the seal film opposed to the cover film.

16. A liquid container having a hole, the liquid container comprising:

a cover film welded or bonded to the liquid container, the cover film having a bore in a hole covering area thereof which covers the hole of the liquid container, and a portion without film outside of the hole covering area;

a recess disposed outside the hole covering area with the recess surrounding the bore; and a seal film welded or bonded to the liquid container through the portion of the cover film in such a manner as to cover the bore of the cover film and the hole of the liquid container.

17. The liquid container according to claim 16, wherein the portion is formed by removing a portion of the cover film in such a manner as to expose a hole forming surface of the liquid container having the hole.

18. The liquid container according to claim 16, wherein the liquid container has a hole forming surface in which the hole is formed, at least the hole forming surface of the liquid container being formed of a thermally meltable material, and wherein the seal film has a thermally meltable surface and is heat-welded to the hole forming surface of the liquid container through the portion of the cover film.

19. The liquid container according to claim 16, wherein the portion without film of the cover film is annular or spiral-shaped so as to encompass the hole covering area of the cover film.

20. The method according to claim 1, wherein forming a recess comprises forming a recess in the cover film.

21. The method according to claim 1, wherein the seal film is heated so that the molten seal film enters the recess of the cover film.

22. The method according to claim 7, wherein forming a recess comprises forming a recess in the cover film.

23. The method according to claim 7, wherein the seal film is heated so that the molten seal film enters the recess of the cover film.

24. The apparatus of claim 15, wherein the recess is formed in the cover film.

25. The apparatus of claim 15, wherein the heating device heats the seal film so that the molten seal film enters the recess of the cover film.

26. The liquid container according to claim 16, wherein the recess is formed in the cover film.

27. The liquid container according to claim 16, wherein the seal film is heated so that the molten seal film enters the recess of the cover film.

* * * * *